US005444593A

United States Patent [19]

Allina

[11] Patent Number: 5,444,593

[45] Date of Patent: Aug. 22, 1995

[54] THICK-FILM VARISTORS FOR TVSS

[76] Inventor: Edward F. Allina, 605 Capri Blvd., Treasure Island, Fla. 33706

[21] Appl. No.: 129,447

[22] Filed: Sep. 30, 1993

[51] Int. Cl.[6] ..... H01C 1/012

[52] U.S. Cl. ..... 361/56; 361/91; 361/111; 361/118; 361/127

[58] Field of Search ..... 361/56, 91, 111, 118, 361/119, 127; 338/21, 308, 314

[56] References Cited

U.S. PATENT DOCUMENTS 4,349,496 9/1982 Levinson ..... 338/21

5,276,423 1/1994 Breit et al. ..... 338/308

*Primary Examiner*—Marc S. Hoff
*Assistant Examiner*—S. Jackson
*Attorney, Agent, or Firm*—Charles A. McClure

[57] ABSTRACT

Thick-film varistors are made by melting and flame-spraying of precursor particulates onto circuit board substrate material already provided with conductive layers or laminae preferably on both sides. The resulting circuit boards are useful in transient voltage surge suppression (TVSS), such as in a TVSS watt-hour meter adapter.

11 Claims, 1 Drawing Sheet

THICK-FILM VARISTORS FOR TVSS

TECHNICAL FIELD

This invention relates to molten spray formation of varistors and use of resulting thick-film varistors, as on circuit boards in transient voltage surge suppression (TVSS).

BACKGROUND OF THE INVENTION

Varistors are commonly made by sintering particulate metal oxides, with or without minor amounts of other inorganic materials, as in disk or rod form. They have non-linear electrical resistance over a range of applied voltages, often only slightly conductive at customary power line voltage but increasingly conductive at higher voltages. Varistors are frequently interposed between an upstream power source and downstream electrical equipment powered from that source for protection of such load equipment against over-voltages. Varistors function by shunting to ground the brief but extremely high currents resulting from transient voltage spikes present on the power lines, such as may result from lightning or faulty switching. See my U.S. Pat. Nos. 4,866,560; 4,901,187; 4,907,119; and 4,931,895; which illustrate diverse arrangements of varistors providing TVSS.

Sintered varistor compositions are so hard that it is hardly practical to subdivide such a structure into thin wafer-like units. In conventional practice, particulate constituents are die-pressed together into individual self-supporting form and then are sintered.

An alternative is the so-called "thick film" varistor, which is formed in place from similar particulate material, whether dry or in paste form, as on a non-conductive substrate, which al so usually carries connecting terminals. In such varistors electrical conduction occurs mainly along—rather than perpendicular to—the thin varistor dimension. Examples of such varistors in U.S. patents are disclosed by Jefferson in U.S. Pat. No. 3,916,366 and also by Aoki et al. in U.S. Pat. No. 4,333,861; whereas examples of suitable varistor compositions appear in such U.S. Pat. Nos. as 4,045,374; 4,211,994; and 4,794,048.

SUMMARY OF THE INVENTION

A primary object of the present invention is to form a thick-film varistor more expeditiously than has been done heretofore.

Another object of this invention is to form such varistors on a circuit board adapted to carry transient voltage surge suppression (TVSS) circuitry.

A further object is to provide varistors for a plurality of phase lines on a single circuit board carrying TVSS circuitry.

In general the objects of the present invention are attained by depositing the varistor composition onto a non-conductive substrate having a face thereof provided beforehand with conductive terminals.

More particularly, varistor precursor solid particulates are converted into molten form and then are sprayed onto the substrate, where a solid layer thereof collects in solid form to desired depth. The spray is created by feeding the preselected particles into an extremely hot zone where they melt very quickly and where expanding hot gas entrains and propels them forcibly and rapidly to a target, conveniently a circuit board substrate provided with conductors.

Other objects of the present invention, together with means and methods for attaining the various objects, will be apparent from the following description and accompanying diagrams of preferred embodiments, which are presented by way of example rather than limitation.

DESCRIPTION OF THE INVENTION

Figure 1:
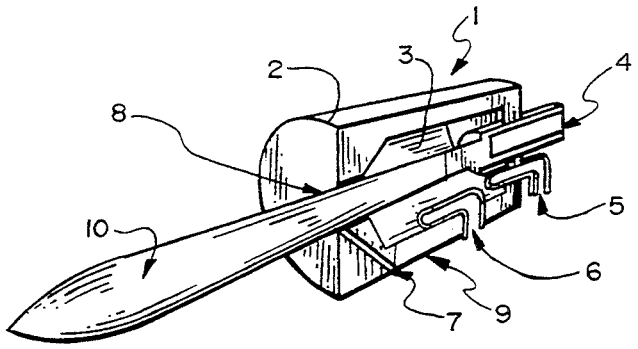
FIG. 1 is a perspective cutaway schematic view of molten spray apparatus useful according to the present invention.

FIG. 1 shows, in a schematic perspective view, embodiment 1 of flame spray apparatus 1. Cylindrical housing 2 (marked "−") surrounded by layer 9 of insulation bounds chamber 3 open at front 8 (left), from which flame 10 sprays, and closed at the rear (right) by plug 2 (marked "+") preferably insulated on its cylindrical surface. Gas inlets 5 and 6 just ahead of the plug open through the housing into the chamber, as does particulate inlet 7 just behind the open end of the chamber. The flame spray consists of hot gas and entrained molten particulates, considered further below in a summary of the operation compatible with either arc or combustible fuel operating modes. Not shown is a housing cooling jacket with inlet.

Figure 2A:
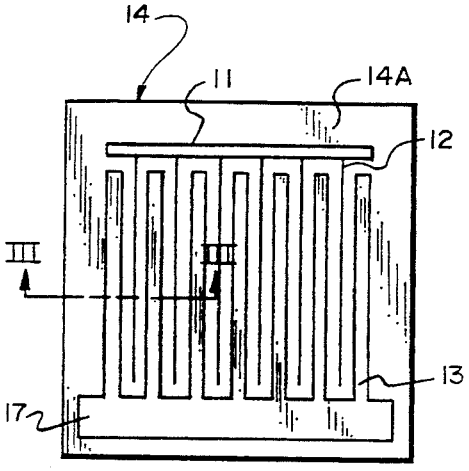
FIG. 2A is a top plan view of a circuit board for varistors to be formed thereon by means of apparatus such as shown in FIG. 1.
Figure 2B:
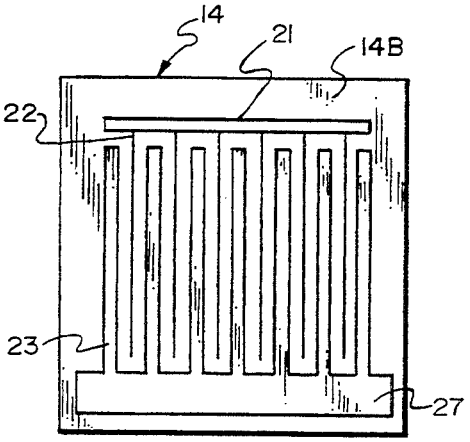
FIG. 2B is a bottom plan view of such board to be so treated.

FIG. 2A shows, in top plan, face 14A of circuit board 14. This face bears narrow laminar terminal strip 11 (adapted to be connected to line power phase A as in FIG. 5). A half dozen mutually parallel narrower laminar conductors 12, spaced evenly apart, extend perpendicular to the terminal strip across most of the face of the board. Wider laminar ground-plane terminal strip 17 parallels the opposite edge of the board, and from it seven not-so-wide laminar ground conductors 13 extend (perpendicular thereto) interleaved parallel to and spaced from phase conductors 12, each of which is consequently flanked by a pair of such ground conductors.

FIG. **2*b* shows, in bottom plan, face 14B of same circuit board 14. This face bears narrow laminar terminal strip 21 (connectable to line power phase B as in FIG. 5) from which six narrower laminar conductors 22 extend perpendicularly across most of the face of the board, together with wide laminar ground plane terminal strip 27, from which seven not-so-wide laminar ground conductors 2 extend interleaved parallel to and spaced from laminar conductors 24**, each of which is consequently flanked by a pair of such ground conductors.

Figure 3:
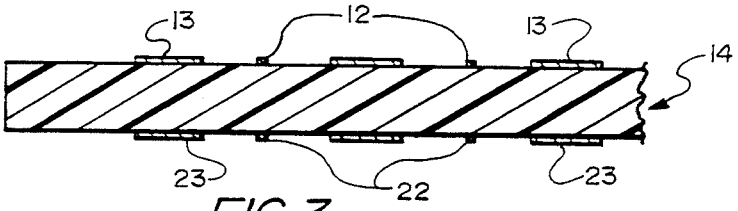
FIG. 3 is a vertical section through the circuit board of FIGS. 2A and 2B, taken as indicated at III—III on FIG. 2A.

FIG. 3 shows, in transverse section along III—III on FIG. 2A, a representative portion of circuit board 30. The board bears on its top face 31 spaced ground conductors 14 and interleaved narrower phase conductors 12, and on its bottom face 32 spaced ground conductors 24 and narrower interleaved phase conductors 22.

Figure 4:
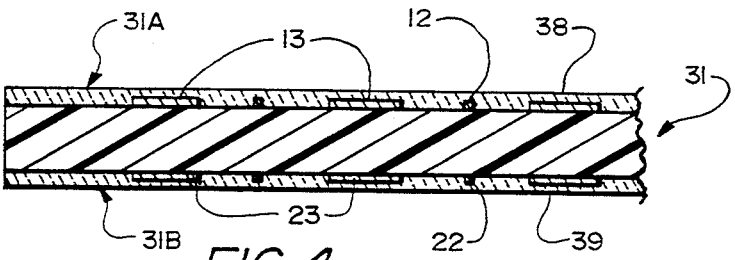
FIG. 4 is a similar section through such circuit board after having had thick-film varistors so formed thereon.

FIG. 4 shows, similarly to FIG. 3, a representative portion of such circuit board (now designated 31) coated on its upper face 31A and lower face 31B with thick-film layers 38 and 39, of varistor material formed from particulates injected into the arc, melted, and deposited to solidify thereon and cover the upper and lower faces.

Figure 5:
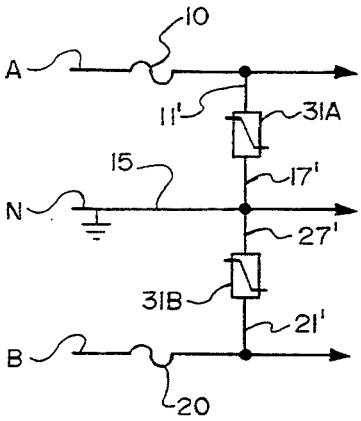
FIG. 5 is a schematic diagram of an example of TVSS (transient voltage surge suppression) circuitry with the resulting varistors.

FIG. 5 shows, in electrical schematic form, respective remote power source phase leads A and B provided with over-current fuses 10 and 20 therein, and neutral (N) ground lead 15. Arrowheads on the lines point in the downstream direction, where electrical load equipment (not shown here) is located to be powered through these leads. The respective phase lines have varistors 14' connected between them and ground. Interconnecting lead 11' connects from phase line A to terminal strip 11 of one varistor face 31A of circuit board 31, whose ground terminal strip 17 is connected by lead 17' to neutral line 15. Interconnecting lead 21' connects from phase line B to terminal strip 21 of other varistor face 31B of circuit board 31 whose ground terminal strip 27 is connected by lead 27' to line 15 (N).

It will be understood that a transient voltage surge appearing between either power phase line and ground produces a current surge through the corresponding varistor to ground, whereupon the voltage downstream of the varistors is substantially undisturbed and does not affect the load equipment adversely as the surge voltage might have done if it had proceeded downstream instead of being clipped by such varistor. TVSS apparatus including such varistors so connected may be installed at the conventional watt-hour meter, as in a meter adapter that plugs between the meter and its conventional socket, or at a weatherhead upstream of the meter, or at a control box or panel downstream of the meter but upstream of equipment to be protected.

This invention can be practiced with apparatus and compositions readily available from commercial sources. Non-conductive circuit boards are provided by numerous suppliers of electronic materials. Flame spray apparatus useful with varistor precursor compositions is available from from Miller Thermal, Inc. of Appleton, Wis. Suitable particulate oxides, including zinc and others, are available from INCO Specialty Powder Products, Saddle Brook, N.J.

Suitable flame spray apparatus may be selected for operation in either of two main modes, as follows. In fuel combustion operation, gaseous fuel compositions, such as oxygen and acetylene, are fed into the respective fuel inlets to burn explosively within the housing, and to expel the flame of resulting hot gases out the open end of the housing. In arc operation, a negative electrical potential is applied to the housing proper (as a cathode) and a positive potential to the housing plug (as an anode), an inert gas such as argon or helium is fed into one "fuel" inlet, and and an arc is struck in any suitable manner, such as inducing a high-frequency A.C. voltage across the electrodes, whereupon the resulting flaming arc is expelled similarly from the open end of the housing.

In either mode of operation, a supply of suitable particulate material is fed into the housing of the apparatus through the forward inlet, is entrained by the hot gas, and is expelled forcibly out the open end of the housing and onto the circuit board or other article to be coated therewith. The operation bears a substantial resemblance to paint spraying, so an operator of spraying apparatus can soon learn to use the appropriate spraying apparatus here. The apparatus may indeed be in portable gun form manually operable by an operator. For repeated spraying of circuit boards or other uniform or similar articles, a fixed sprayer is preferably mounted opposite an assembly line carrying such circuit boards or other articles and is automatically controlled to start and stop spraying as they pass.

The sprayed molten particles of metal oxides or other particulates solidify upon impact into a layer or "thick film" whose depth at any given location depends upon duration of the spraying thereon. If the housing is provided with a cooling jacket (not shown) water may be fed to it to keep the housing from degrading excessively from the heat—and from acting as a cathode in the arc mode of operation or from chemical attack in the fuel combustion mode. In either mode the housing is made of highly heat-resistant metal such as tungsten, and if intended for use in the arc mode the rear plug is copper or other very good electrical conductor. The housing outlet at the front may be provided with replaceable orifice inserts to enhance control of the outlet size and to combat erosion there.

It is desirable to spray an even layer of the molten particulates onto each side of the circuit board to a depth suited to the currents to be carried, usually not exceeding several millimeters. The spacing of the conductors on the circuit board is usually greater than the thickness of the varistor layer, and the number of conductors is also a function of the frequency and extent of surges to be conducted. The illustrated arrangement on a board measuring about 10 to 15 mm by about 20 to 30 mm should prove satisfactory for TVSS use in most residential or small business settings. Circular boards suitably patterned are particularly useful in watt-hour meter adapters, as in my concurrently filed patent application Ser. No. 129,448

Though the molten varistor material is extremely hot, it cools somewhat on the way to the target substrate, and the intervening distance is adjusted so that it arrives in condition to form a coherent layer and to solidify upon contact. The conductive laminae on the substrate aid in the process as a heat-sink and an impact buffer.

Whereas a circuit board as substrate has been illustrated with conductive terminals pre-attached thereto, terminals can be added as may be desired, and/or connections may be made to the exterior face of a resulting thick-film varistor, if preferred. The substrate is preferably made of a thermosetting resin, such as an acetal or epoxy or a phenol or melamine formaldehyde condensation product, with or without reinforcing fibers of glass or other compatible material.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

The claimed invention:

1. Transient voltage surge suppression (TVSS) apparatus, comprising a circuit board having distinct laminar electrical conductors spaced apart on a face thereof, covered with a thick-film varistor, and adapted to be connected respectively to a power line phase lead and ground.

2. TVSS apparatus according to claim 1, wherein the circuit board has on each side such a conductor arrangement and thick-film varistor, being connected between respective phase leads and ground.

3. TVSS apparatus according to claim 1, wherein the laminar counductors adapted to be connected to a phase line are interleaved in spaced configuration between the laminar conductors adapted to be connected to ground, which are similarly interleaved and spaced.

4. TVSS apparatus according to claim 3, wherein the interleaved laminar conductors adapted to be connected to a phase line are narrower than the interleaved laminar conductors adapted to be connected to ground.

5. Transient voltage surge suppression (TVSS) apparatus, comprising a rectangular laminar non-conductive substrate having two opposite faces, at least one face carrying these laminar structures:

a first conductive terminal strip paralleling one side edge of the rectangular substrate face in a plane contiguous with the face, a first plurality of coplanar mutually parallel conductive strips spaced laterally apart and extending from conductive contact with the first terminal strip across part of the face, a second conductive terminal strip paralleling the opposite side edge of the rectangular substrate face in the same plane, a second plurality of coplanar mutually parallel conductive strips spaced laterally apart and extending from conductive contact with the second terminal strip and across part of the face, the first and second mutually parallel conductive strips being interleaved with and spaced laterally from one another and also being spaced laterally apart and lengthwise apart from conductive contact with the terminal strip for the other parallel strips.

6. TVSS apparatus according to claim 5, wherein both faces carry like laminar structures.

7. TVSS apparatus according to claim 5, wherein the second mutually parallel conductive strips are wider than the first ones.

8. TVSS apparatus according to claim 7, wherein the first mutually parallel conductive strips are connected through their terminal strip to an electrical source phase line, and wherein the second mutually parallel conductive strips are connected through their terminal strip to ground.

9. Method of providing thick-film varistors, including the steps of providing a non-conductive substrate with at least two distinct conductors on a face thereof, spraying molten varistor precursor particulates onto the surface to cover in part the conductors thereon in electrically conductive contact therewith to a desired depth, and patterning the distinct conductors in substantial part in mutually parallel interleaved rows spaced apart and joined to respective terminal strips for the distinct conductors.

10. Method of forming a thick-film varistor comprising the steps of treating a two-faced non-conductive laminar substrate by affixing distinct laminar electrical conductors onto the non-conductive laminar substrate in spaced parallel rows connected to respective distinct terminal strips, selecting varistor precursor particulates for melting and injecting such particulates into a flame and so melting them, impacting such molten particulates onto such non-conductive laminar substrate and such distinct electrical conductors, and solidifying such particles into varistor form over and in electrically conductive contact with such distinct conductors.

11. Method according to claim 10 performed on both faces of such a laminar substrate to form plural thick-film varistors.

* * * * *